US007993159B2

(12) United States Patent
Chawgo

(10) Patent No.: US 7,993,159 B2
(45) Date of Patent: Aug. 9, 2011

(54) COMPRESSION CONNECTOR FOR COAXIAL CABLE

(75) Inventor: Shawn Chawgo, Cicero, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 677 days.

(21) Appl. No.: 11/743,633

(22) Filed: May 2, 2007

(65) Prior Publication Data

US 2008/0274643 A1 Nov. 6, 2008

(51) Int. Cl.
*H01R 9/05* (2006.01)

(52) U.S. Cl. ..... 439/584

(58) Field of Classification Search ..... 439/583, 439/584, 578

See application file for complete search history.

(56) References Cited

U.S. PATENT DOCUMENTS

| | | | | |
|---|---|---|---|---|
| 4,676,577 | A | 6/1987 | Szegda | |
| 4,952,174 | A * | 8/1990 | Sucht et al. | 439/584 |
| 6,183,298 | B1 | 2/2001 | Henningsen | |
| 6,386,915 | B1 | 5/2002 | Nelson | |
| 6,478,618 | B2 | 11/2002 | Wong | |
| 6,607,398 | B2 | 8/2003 | Henningsen | |
| 6,840,803 | B2 | 1/2005 | Wlos et al. | |
| 6,884,113 | B1 | 4/2005 | Montena | |
| 6,939,169 | B2 | 9/2005 | Islam et al. | |
| 6,955,562 | B1 | 10/2005 | Henningsen | |
| 7,021,965 | B1 | 4/2006 | Montena | |
| 7,029,326 | B2 | 4/2006 | Montena | |
| 7,070,447 | B1 | 7/2006 | Montena | |
| 7,077,699 | B2 | 7/2006 | Islam et al. | |
| 7,086,897 | B2 | 8/2006 | Montena | |
| 7,104,839 | B2 * | 9/2006 | Henningsen | 439/584 |
| 7,131,868 | B2 * | 11/2006 | Montena | 439/583 |
| 7,347,729 | B2 * | 3/2008 | Thomas et al. | 439/583 |
| 2006/0134979 | A1 | 6/2006 | Henningsen | |
| 2006/0199431 | A1 | 9/2006 | Paynter | |

* cited by examiner

*Primary Examiner* — Briggitte R Hammond

(74) *Attorney, Agent, or Firm* — Schmeiser, Olsen & Watts, LLP

(57) ABSTRACT

A compression connector for smooth walled, corrugated, and spiral corrugated coaxial cable includes an insulator disposed within the body, wherein the insulator contains a central opening therein which is dimensioned smaller than a collet portion, or second clamp, which seizes a center conductor of the coaxial cable. The connector also includes a first clamp disposed inside the body as well as a compression sleeve assembly. The body includes a transitional surface separating the body into two regions of different inside diameter. When an axial force is applied to the compression sleeve, the clamp is forced by the transitional surface into the body region having a smaller diameter, causing the clamp to squeeze onto an outer conductor layer of the coaxial cable. At approximately the same time, the collet portion is forced through the central opening, causing the collet portion to squeeze onto the center conductor.

36 Claims, 15 Drawing Sheets

COMPRESSION CONNECTOR FOR COAXIAL CABLE

FIELD OF THE INVENTION

This invention relates generally to the field of coaxial cable connectors, and more particularly to a compression connector for smooth walled, corrugated, and spiral corrugated coaxial cable.

BACKGROUND OF THE INVENTION

Coaxial cable is installed on a widespread basis in order to carry signals for communications networks such as cable television (CATV) and computer networks. The coaxial cable must at some point be connected to network equipment ports. In general, it has proven difficult to make such connections without requiring labor intensive effort by highly skilled technicians.

These generalized installation problems are also encountered with respect to spiral corrugated coaxial cable, sometimes known as "Superflex" cable. Examples of spiral corrugated cable include 50 ohm "Superflex" cable and 75 ohm "coral" cable manufactured by Andrew Corporation (www.andrew.com). Spiral corrugated coaxial cable is a special type of coaxial cable that is used in situations where a solid conductor is necessary for shielding purposes, but it is also necessary for the cable to be highly flexible. Unlike standard coaxial cable, spiral corrugated coaxial cable has an irregular outer surface, which makes it difficult to design connectors or connection techniques in a manner that provides a high degree of mechanical stability, electrical shielding, and environmental sealing, but which does not physically damage the irregular outer surface of the cable. Ordinary corrugated, i.e., non-spiral, coaxial cable also has the advantages of superior mechanical strength, with the ability to be bent around corners without breaking or cracking. In corrugated coaxial cables, the corrugated sheath is also the outer conductor.

When affixing a cable connector to a corrugated coaxial cable, it is necessary to provide good electrical and physical contact between the cable connector and the center and outer conductors of the cable. It is also desirable to connect the center and outer conductors without having to reposition the cable connector within a connecting tool during the connection operation. Compression connectors for coaxial cable are known which require dual stage compression to independently activate both inner conductor and outer conductor mechanisms, thus requiring a complex compression tool to accomplish the compression when installing the compression connector onto the coaxial cable.

SUMMARY OF THE INVENTION

Briefly stated, a compression connector for smooth walled, corrugated, and spiral corrugated coaxial cable includes an insulator disposed within the body, wherein the insulator contains a central opening therein which is dimensioned smaller than a collet portion which seizes a center conductor of the coaxial cable. The connector also includes a clamp disposed inside the body as well as a compression sleeve assembly. The body includes a transitional surface separating the body into two regions of different inside diameter. When an axial force is applied to the compression sleeve, the clamp is forced by the transitional surface into the body region having a smaller diameter, causing the clamp to squeeze onto an outer conductor layer of the coaxial cable. At approximately the same time, the collet portion is forced through the central opening of the insulator, causing the collet portion to squeeze onto the center conductor. The collet portion can be designed to be simultaneously squeezed onto the center conductor at the same time the clamp compresses the outer conductor layer, or the engagement of the collet portion with the center conductor can be designed to be delayed.

According to an embodiment of the invention, a compression connector for a coaxial cable, wherein the coaxial cable includes a center conductor surrounded by a dielectric, which dielectric is surrounded by a conductor layer, includes a connector body having a first end and a second end and a central passageway therethrough; an insulator disposed within the central passageway at the first end of the body; the insulator having an opening therein; a compression sleeve assembly connected to the second end of the body; first clamp means, disposed in the central passageway, for clamping onto the conductor layer; and second clamp means, disposed within the central passageway, for clamping onto the center conductor, whereby upon axial advancement of the compression sleeve assembly from the second end to the first end, the first and second clamp means are radially compressed inwardly.

According to an embodiment of the invention, a method for installing a compression connector onto a coaxial cable, wherein the coaxial cable includes a center conductor surrounded by a dielectric, which dielectric is surrounded by a conductor layer, includes the steps of (a) providing a connector body having a first end and a second end and a central passageway therethrough; (b) providing an insulator disposed within the central passageway at the first end of the body; (c) providing an opening within the insulator; (d) connecting a compression sleeve assembly to the second end of the body; (e) providing a first clamp for clamping onto the conductor layer, the first clamp being disposed in the central passageway; (f) providing a second clamp for clamping onto the center conductor, the second clamp being disposed in the central passageway; and (g) transmitting a force in a longitudinally axial direction of the body from the compression sleeve assembly to both the first and second clamps, wherein an axial movement of the compression sleeve assembly from the second end to the first end causes both the first and second clamps to radially compress inwardly.

According to an embodiment of the invention, a method for manufacturing a compression connector for a coaxial cable, wherein the coaxial cable includes a center conductor surrounded by a dielectric, which dielectric is surrounded by a conductor layer, includes the steps of (a) forming a connector body having a first end and a second end, and a central passageway therethrough; (b) forming an insulator for placement within the central passageway at the first end of the body, wherein the insulator includes an opening therein; (c) forming a compression sleeve assembly for connection to the second end of the body; (d) forming a clamp having an outer diameter and a transition surface disposed on an inside of the body; wherein the shoulder separates the body into a first portion having a first inner diameter and a second portion having a second inner diameter; wherein the outer diameter of the clamp is substantially the same as the first inner diameter, but greater than the second inner diameter; and wherein forcing the clamp in the longitudinally axial direction causes the outer diameter of the clamp to reduce in size as the clamp is forced from the first portion of the body to the second portion of the body; and (e) forming a conductive pin having a collet portion at one end thereof, wherein an outer diameter of the collet portion is greater than a diameter of the opening in the insulator, such that forcing the conductive pin in the longitudinally axial direction causes the outer diameter of the collet portion to reduce in size as the collet portion is forced into the opening, wherein an axial movement of the compression assembly causes both the clamp and the collet portion to clamp inwardly.

According to an embodiment of the invention, a connector for coupling an end of a coaxial cable, the coaxial cable having a center conductor surrounded by a dielectric and the dielectric surrounded by a conductor layer, includes a connector body having a first end and a second end, the connector body extending along a longitudinal axis and having defined therein an internal passageway, the first end having a first outer diameter and a first inner diameter; a first clamp positioned within the first inner diameter and having a first clamp central passageway configured for receiving the conductor layer, the first clamp further having an outer surface for engagement with a first surface on the central passageway configured to radially inwardly compress the first clamp; an insulator axially positioned within the second end of the connector body and having an insulator passageway; a second clamp assembly positioned along the longitudinal axis of the connector body between the first clamp and the insulator and having a second clamp central passageway for receiving the center conductor; the second clamp assembly having a surface portion extending into the insulator passageway; and a compression assembly positioned at the first end of the connector body for engagement with the first clamp, the compression assembly having a compression assembly passageway for receiving the coaxial cable, wherein axial advancement of the compression assembly moves the first clamp member toward the first surface to compress the first clamp radially inwardly to engage the conductor layer of the coaxial cable, and wherein further axial advancement of the compression assembly moves the second clamp assembly surface portion towards the insulator passageway, whereby the second clamp central passageway is radially inwardly compressed to engage the center conductor of the coaxial cable.

According to an embodiment of the invention, a connector for coupling an end of a coaxial cable, the coaxial cable having a center conductor surrounded by a dielectric and the dielectric surrounded by an outer conductor, includes a connector body extending along a longitudinal axis, the connector body having defined therein a connector body central passageway, the connector body having a first end and a second end, the first end having a first end internal diameter and a first end outer diameter; a compression member assembly configured to axially slidably engage the first end outer diameter; a first clamp located within the connector body passageway, the first clamp having a first clamp central passageway, the first clamp central passageway having an internal surface configured to receive the outer conductor of the coaxial cable; a mandrel located within the connector body central passageway for engagement with the first clamp, the mandrel configured to receive the center conductor; a second clamp located within the connector body central passageway, the second clamp having a second clamp central passageway configured to receive the center conductor; and an insulator located within the connector body central passageway, the insulator configured to receive a portion of the second clamp, wherein axial advancement of the compression member assembly along the longitudinal axis of the connector body compresses the first clamp radially inwardly to engage the outer conductor, and wherein further axial advancement of the compression member assembly along the longitudinal axis of the connector body causes movement of the mandrel toward the second clamp, whereby the insulator receives a portion of the second clamp which compresses the second clamp radially inwardly to engage the center conductor.

According to an embodiment of the invention, a method of attaching a connector having an internal passageway to a coaxial cable, the coaxial cable having a center conductor surrounded by an outer conductor, and wherein the connector includes a first clamp, a second clamp, a mandrel and an insulator located within the internal passageway, includes the steps of (a) inserting an end of the coaxial cable into the connector; (b) threading the outer conductor of the coaxial cable into the first clamp of the connector; (c) inserting the center conductor of the coaxial cable into the mandrel and the second clamp; (d) axially advancing the first clamp along a longitudinal axis of the connector body to compress the first clamp radially inwardly to engage the outer conductor; and (e) axially advancing the first clamp further to cause axial movement of the mandrel to advance the second clamp toward the insulator to compress the second clamp radially inwardly to engage the center conductor.

DETAILED DESCRIPTION OF THE PREFERRED EMBODIMENT

Figure 1A:
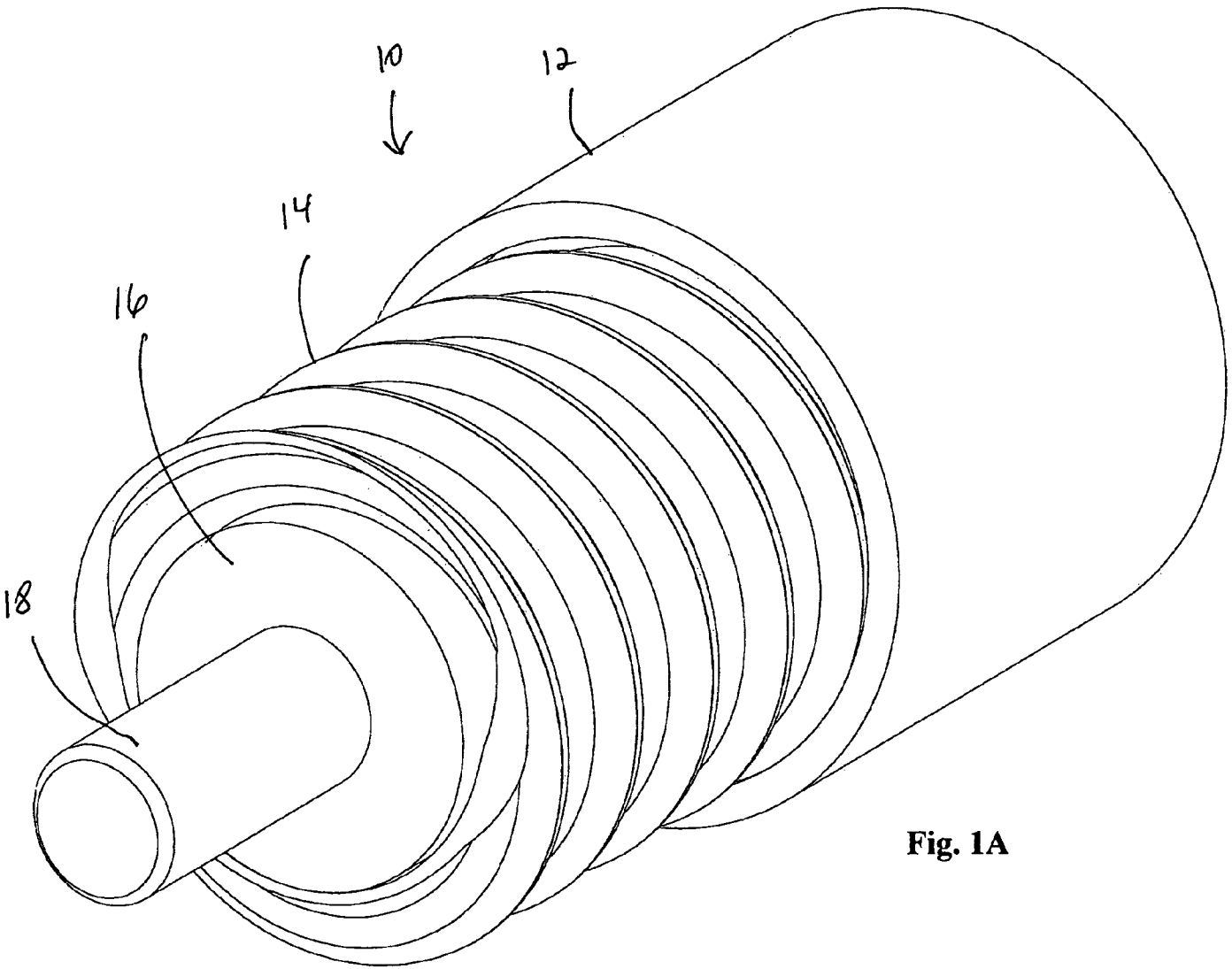
FIG. 1A shows a perspective view of a spiral corrugated coaxial cable where an end has been prepared for engagement with a coaxial cable connector.
Figure 2:
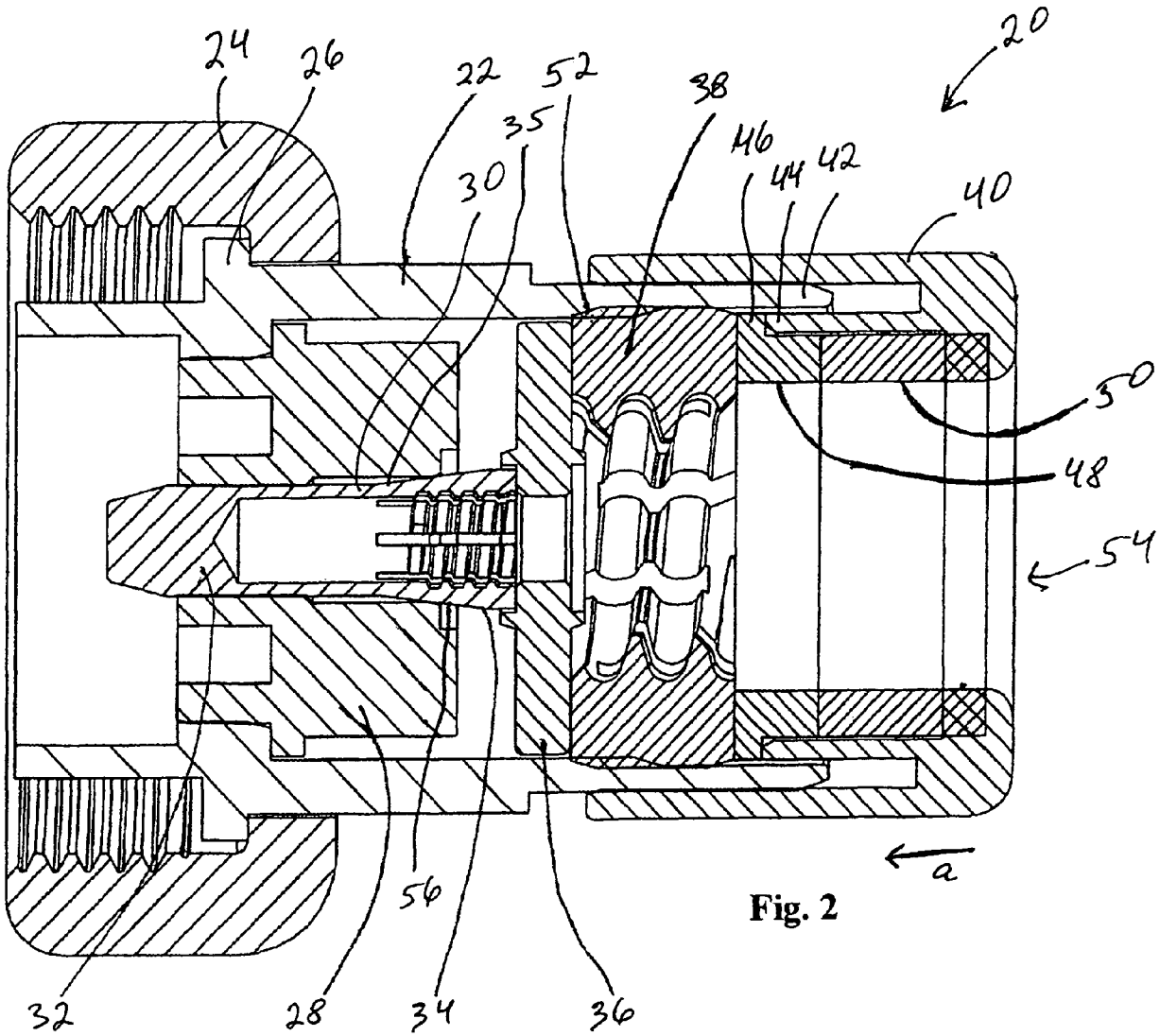
FIG. 2 shows a perspective view with a partial cut-away of a coaxial cable connector in a partially compressed position in accordance with a first embodiment of the present invention.

Referring to FIG. 1A, a spiral corrugated coaxial cable 10 is shown prepared for installation onto a compression connector 20 (FIG. 2). A jacket 12 is cutaway to expose a portion of a spiral corrugated conductor layer 14. Layer 14 is also known as the ground or outer conductor layer. Both corrugated conductor layer 14 and a dielectric 16 are cutaway from a center conductor 18. Preparation of corrugated coaxial cable 10 for installation is well known in the art.

Figure 1B:
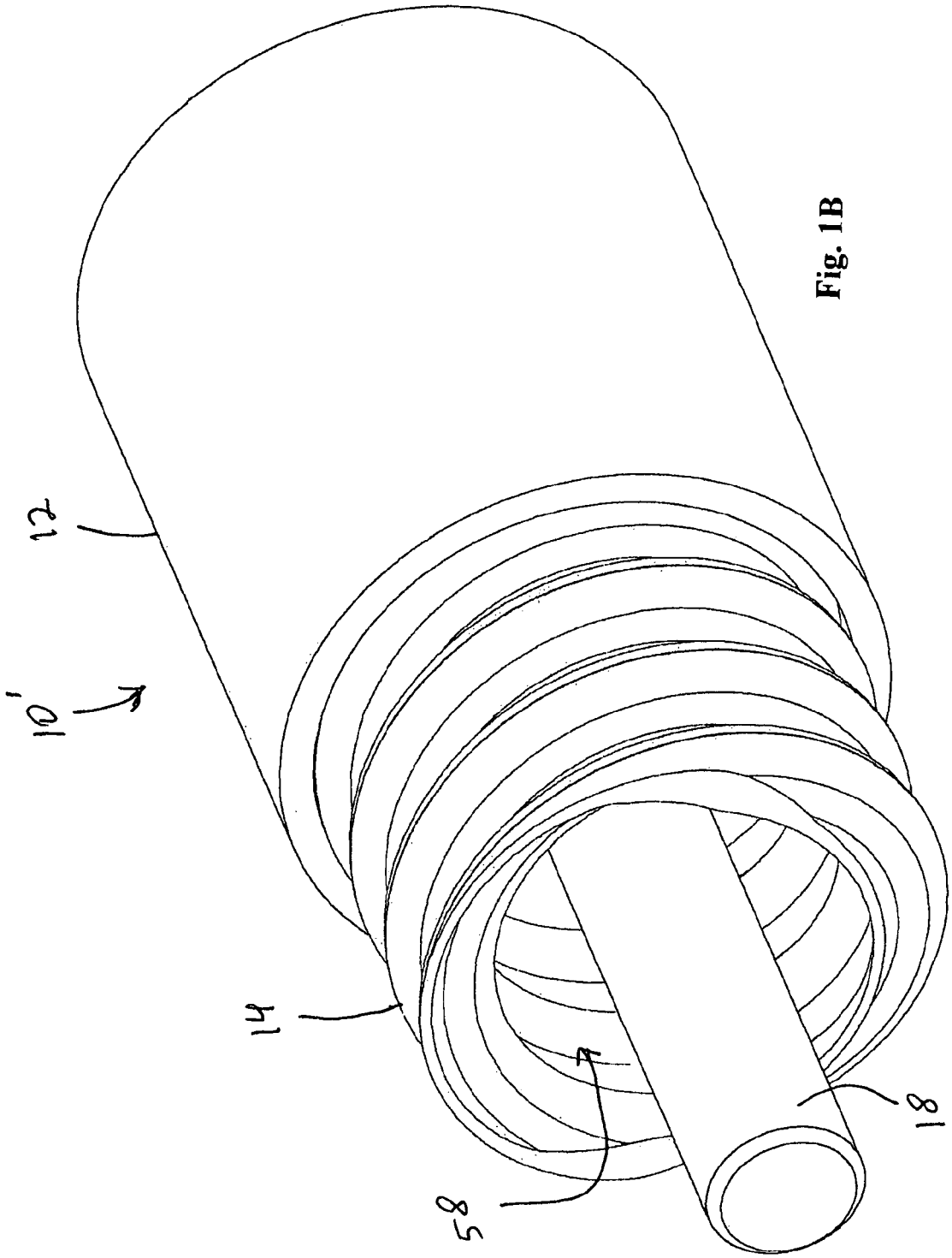
FIG. 1B shows a perspective view of the spiral corrugated coaxial cable of FIG. 1A with the dielectric foam removed.
Figure 6:
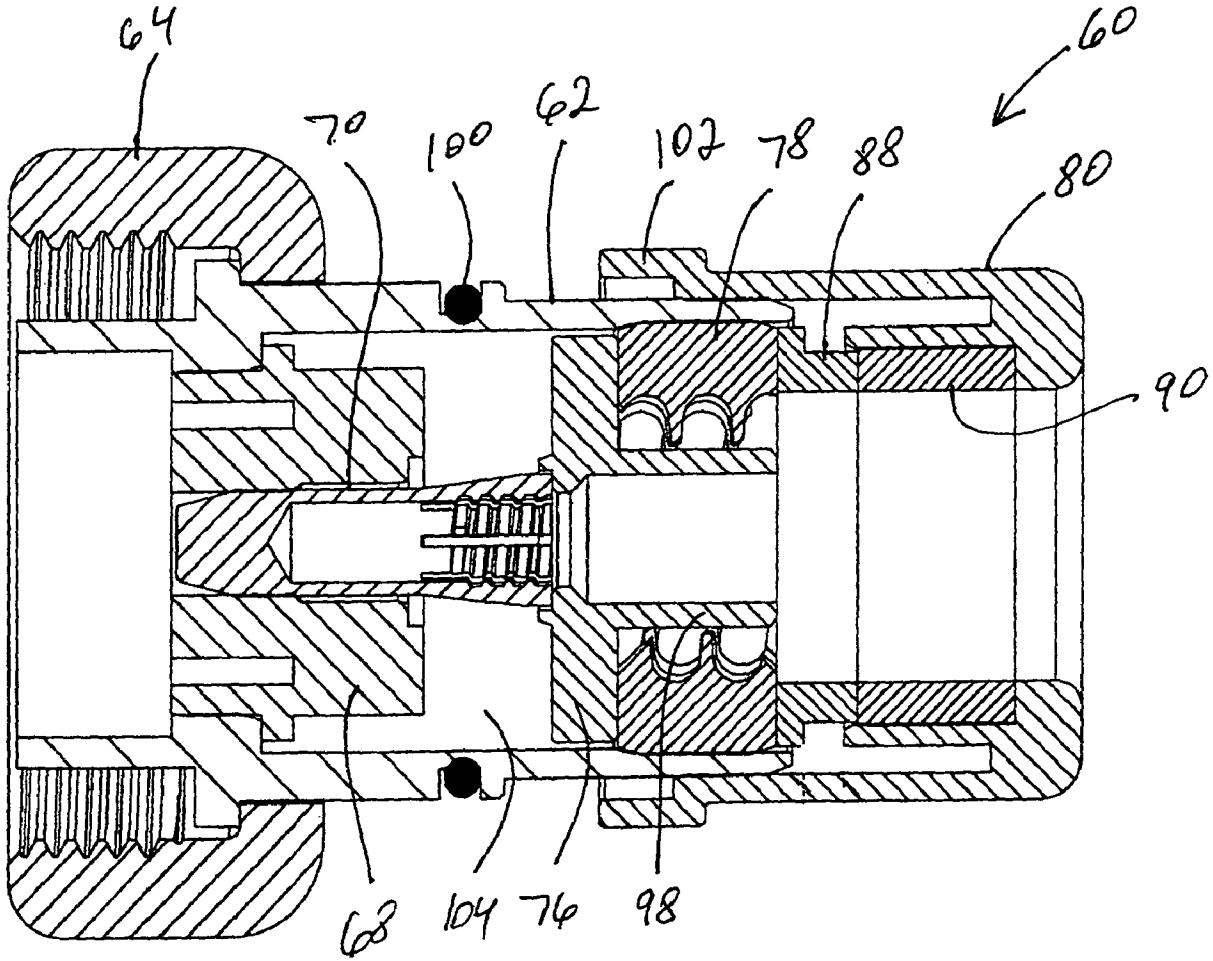
FIG. 6 shows a cross sectional view of a coaxial cable connector in accordance with a variation of the second embodiment of the present invention.

Referring to FIG. 1B, a spiral corrugated coaxial cable 10' is shown prepared for installation onto a compression connector 60 (FIG. 6). In addition to jacket 12 being cutaway to expose a portion of spiral corrugated conductor layer 14, dielectric 16 is cored out leaving a hollow 58 after both corrugated conductor layer 14 and dielectric 16 are cutaway from center conductor 18. Preparation of corrugated coaxial cable 10' for installation is well known in the art.

Figure 1C:
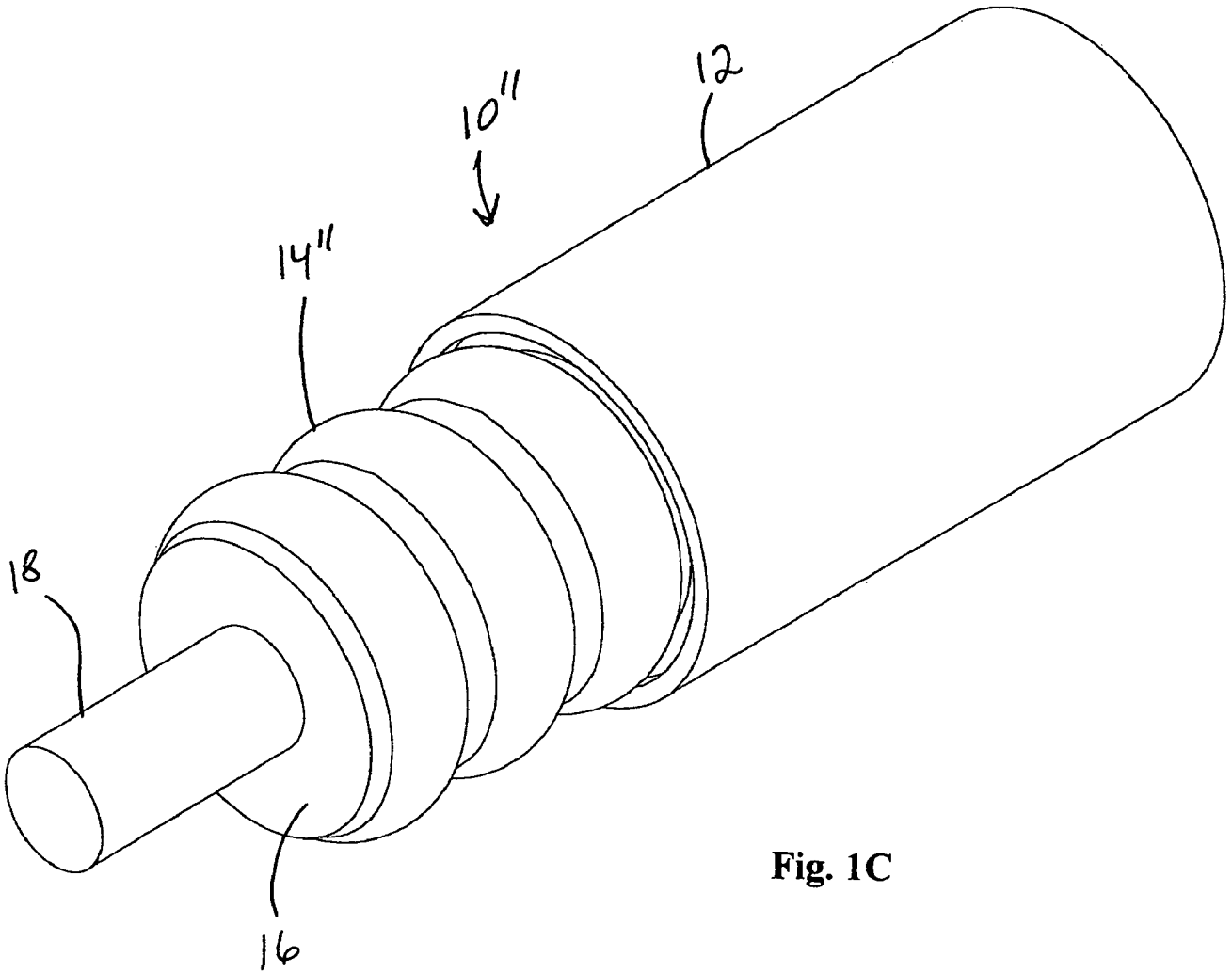
FIG. 1C shows a perspective view of an annular corrugated coaxial cable where an end has been prepared for engagement with a coaxial cable connector.

Referring to FIG. 1C, a non-spiral corrugated coaxial cable 10" is shown prepared for installation onto a compression connector. The preparation of cable 10" is well known in the art, and is the same as previously described with respect to FIG. 1A. Note that corrugated conductor layer 14" is non-spiral, but still corrugated. The basic steps of preparing a corrugated coaxial cable are known in the prior art, such as removing a portion of the cable jacket or coring the dielectric foam. For example, it is known to cut away the corrugated outer conductor in a "valley" to ensure enough of the "peak" is left for outer conductor seizure. However, the present invention allows the outer conductor to be cut in either the "peak" or a "valley" because of the configuration of the inner surface of the outer conductor clamp.

Figure 1D:
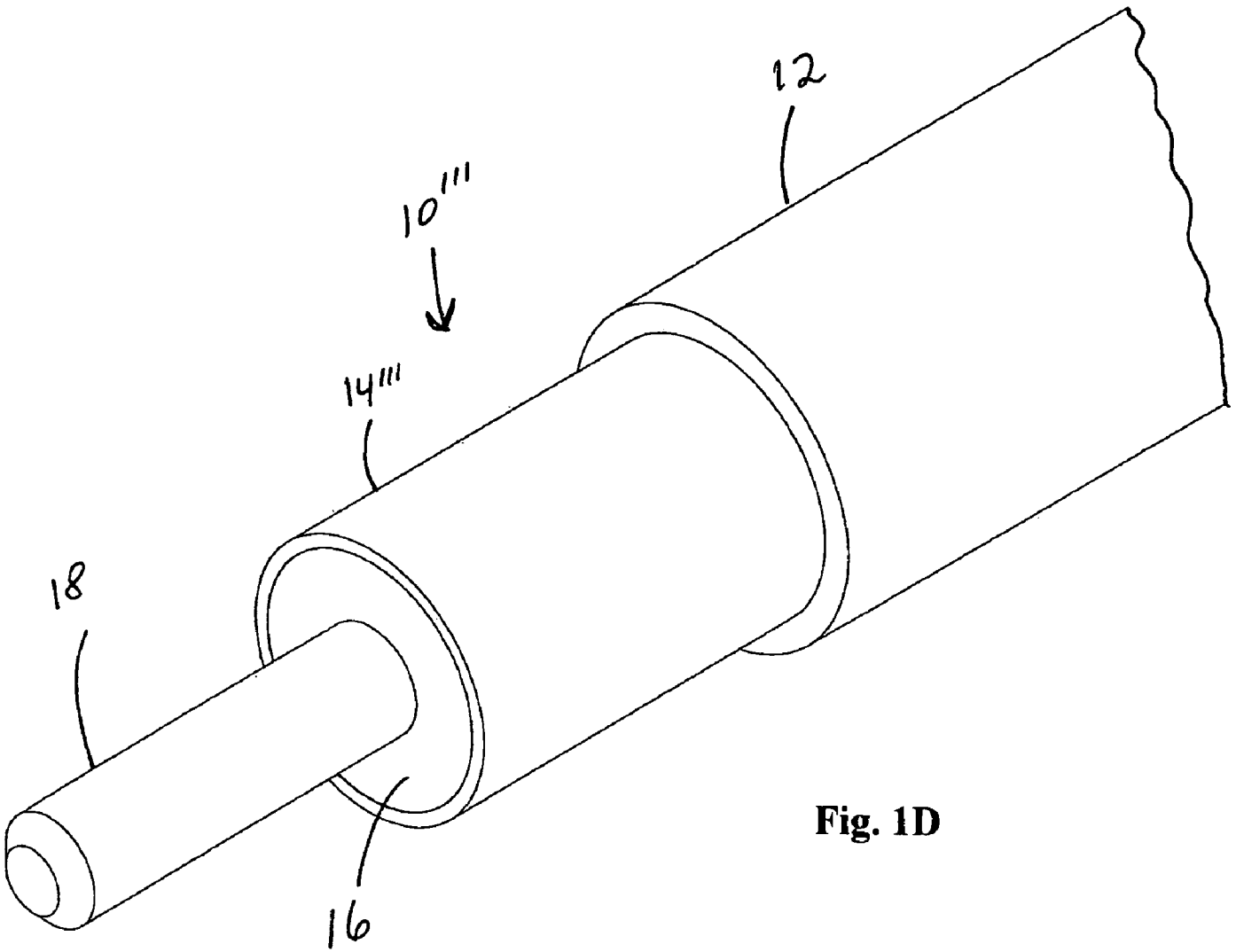
FIG. 1D shows a perspective view of a smooth-walled coaxial cable where an end has been prepared for engagement with a coaxial cable connector.

Referring to FIG. 1D, a smooth walled coaxial cable 10'" is shown prepared for installation onto a compression connector. The preparation of cable 10'" is well known in the art, and is the same as previously described with respect to FIG. 1A. Note that conductor layer 14'" is non-spiral and non-corrugated, i.e., smooth walled.

Figure 1E:
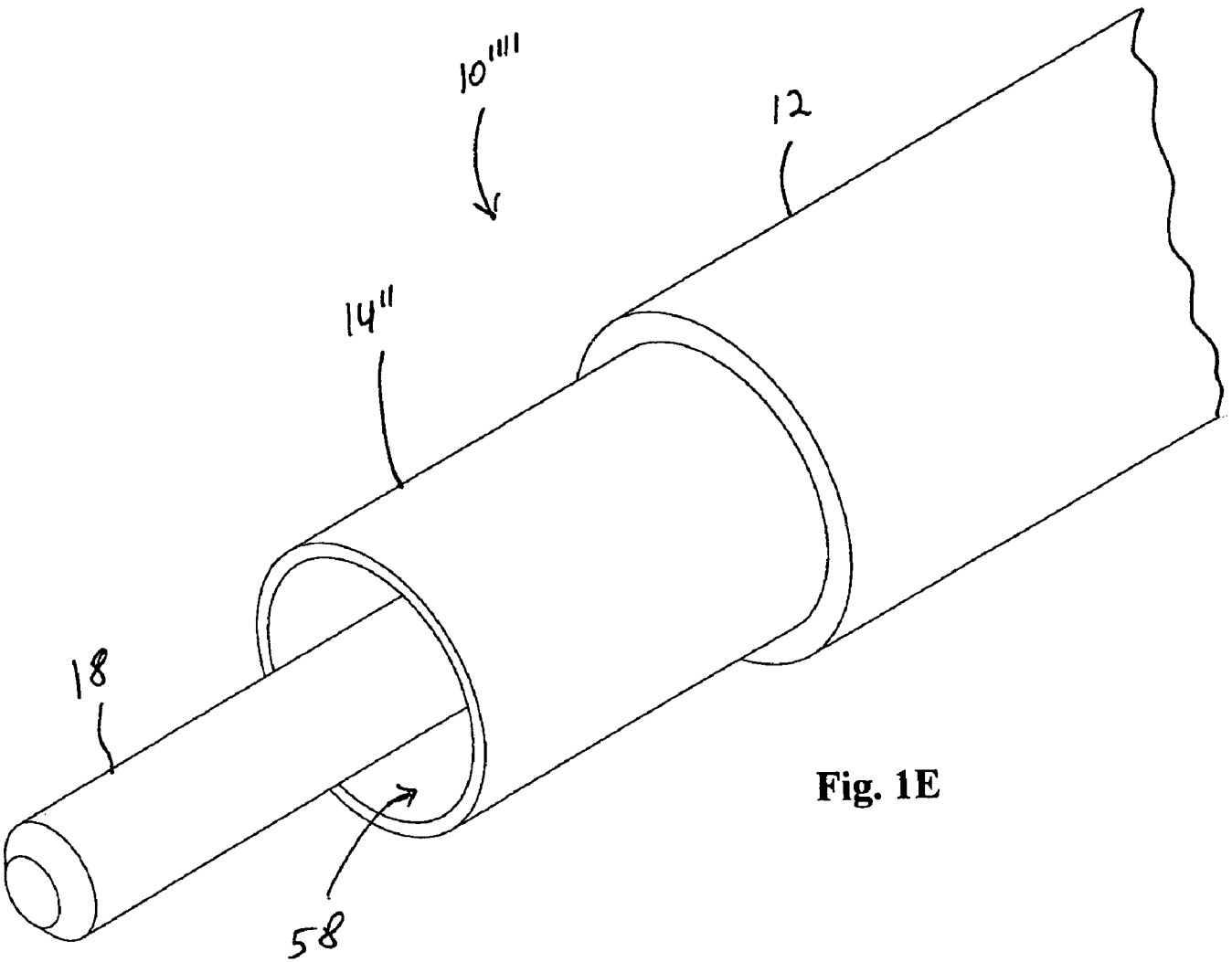
FIG. 1E shows a perspective view of the smooth-walled coaxial cable of FIG. 1D with the dielectric foam removed.

Referring to FIG. 1E, a smooth walled coaxial cable 10"" is shown prepared for installation onto a compression connector. In addition to jacket 12 being cutaway to expose a portion of conductor layer 14", dielectric 16 (FIG. 1D) is cored out leaving a hollow 58 after both conductor layer 14 and dielectric 16 are cutaway from center conductor 18. Preparation of coaxial cable 10"" for installation is well known in the art.

Referring also to FIG. 2, compression connector 20, shown in a partially compressed position, includes a body 22 with a nut 24 connected to body 22 via an annular flange 26. An insulator 28 positions and holds a conductive pin 30 within body 22. Conductive pin 30 includes a pin portion 32 at one end and a collet portion 34 at the other end. A drive insulator or mandrel 36 is positioned inside body 22 between and end of collet portion 34 and a clamp 38. Clamp 38 has an interior annular surface which is geometrically congruent to the spiral of spiral corrugated conductor layer 14. Clamp 38 preferably includes a plurality of slots 39 (FIG. 4) in an outer annular portion of the clamp, so that clamp 38 can be compressed or squeezed inward. A part of a compression sleeve 40 fits over an end 42 of body 22. A drive portion 44 of compression sleeve 40 fits against an annular flange 46 of a drive ring 48. An elastomer seal 50 fits against jacket 12 of corrugated coaxial cable 10 during installation to prevent external environmental influences (moisture, grit, etc.) from entering connector 20 as well as to provide strain relief and increase cable retention.

When prepared corrugated coaxial cable 10 is inserted into an opening 54 of connector 20, cable 10 is twisted as it is inserted so that the spirals on conductor layer 14 fit into the spirals in clamp 38, while center conductor 18 fits into collet portion 34. When compressive force is applied to compression sleeve 40 in the direction indicated by an arrow a, drive portion 44 of compression sleeve 40 drives drive ring 48 against clamp 38, forcing clamp 38 against a transition surface 52 of body 22, which transition surface 52 is configured to radially inwardly squeeze clamp 38 against conductor layer 14, while continuing to move clamp 38 axially in the direction of arrow a. Clamp 38 thus forces mandrel 36 to move in the direction of arrow a, and mandrel 36 forces collet portion 34 of conductive pin 30 through an opening 56 in insulator 28. Opening 56 may take various forms, including convex, concave, or radial. Collet portion 34 also has a collet transition surface 35 configured to compress collet portion 34 radially inwardly upon advancement of conductive pin 30 into opening 56 of insulator 28. Because a diameter of opening 56 is smaller than an outer diameter ramped surface 35 of collet portion 34, collet portion 34 is squeezed onto and seizes center conductor 18 of corrugated coaxial cable 10. During the clamping process, it is noted that center conductor 18, now located within conductive pin 30, does not move relative to pin 30 during the clamping process. With the transition surface as shown in FIG. 2, the collet portion 34 is simultaneously compressed radially inwardly at the same time clamp 38 is compressed radially inwardly. The transition surface 35 however, can be designed to have a portion of surface 35 consistent with the diameter of opening 56. In this instance, the squeezing of collet portion 34 is delayed until a greater advancement of compression sleeve 40.

Figure 3:
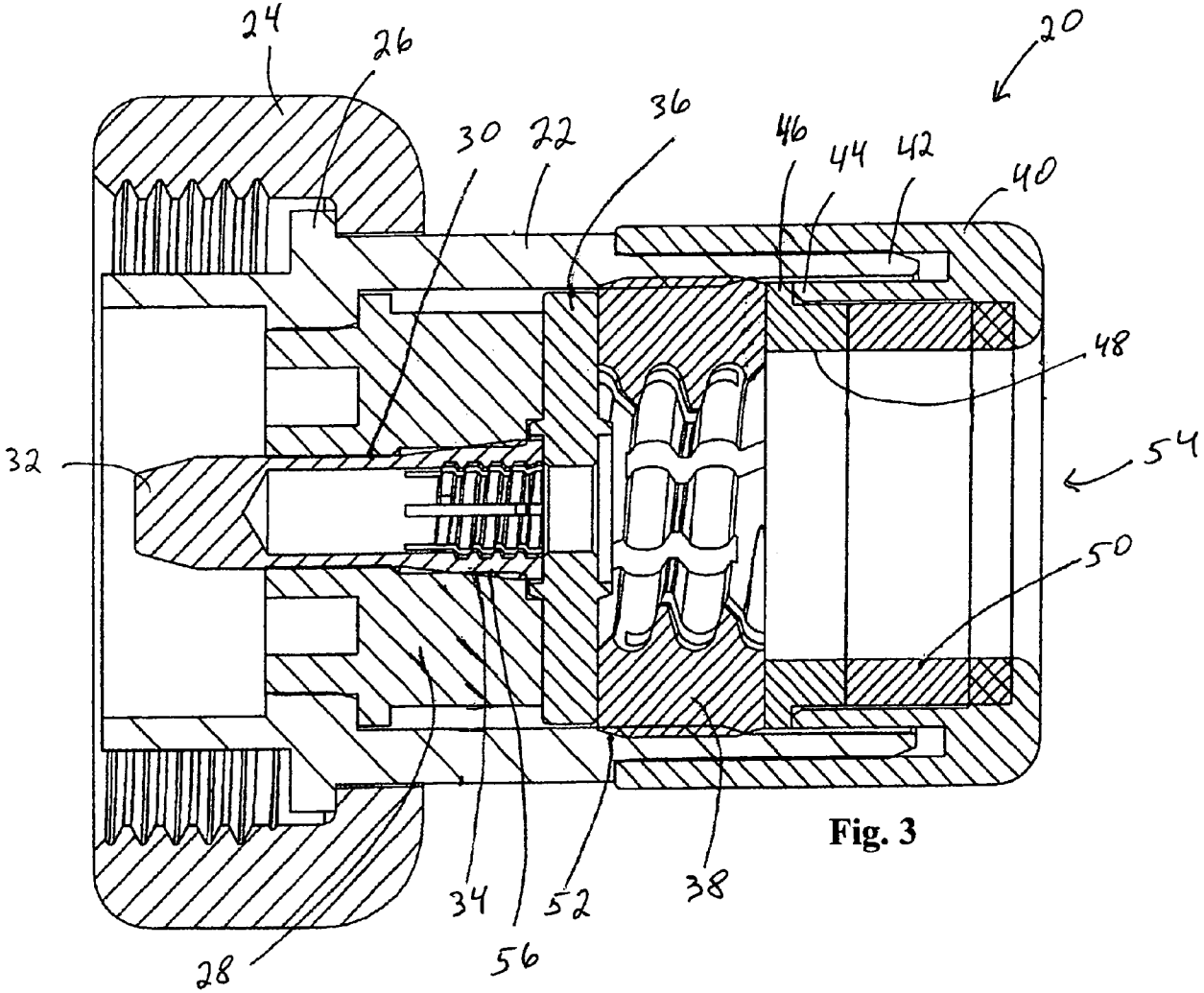
FIG. 3 shows a cross-section of the coaxial cable connector of FIG. 2 shown in the installed position.

FIG. 3 shows the position of the driven and compressed elements of connector 20 after connector 20 is installed onto corrugated coaxial cable 10.

Figure 4:
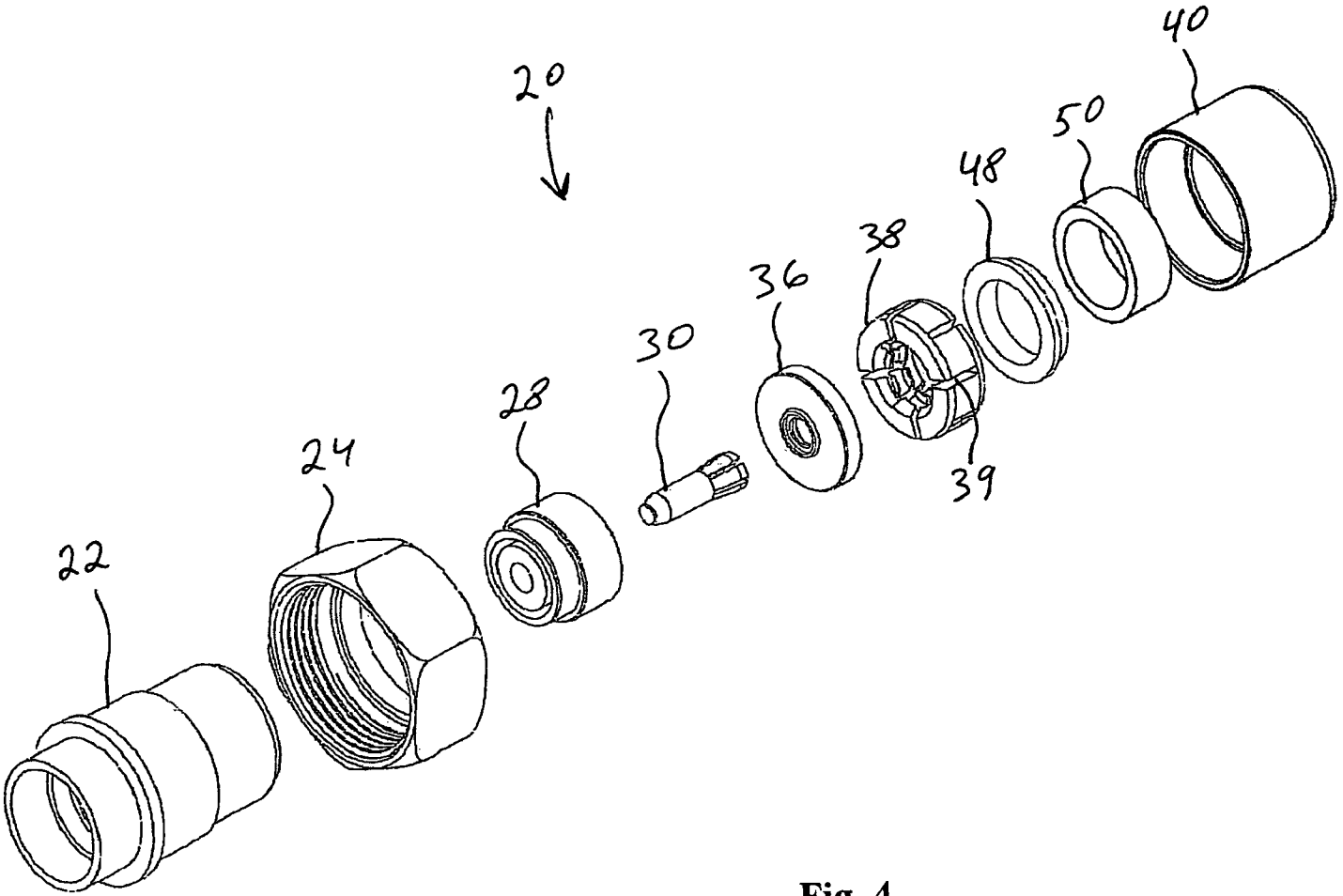
FIG. 4 shows an exploded view of the coaxial cable connector of FIG. 2.

Referring to FIG. 4, an exploded view is shown of the components of connector 20. During preferred assembly of the components of connector 20, conductive pin 30 is inserted into insulator 28, after which the combination is inserted into body 22, followed by mandrel 36, clamp 38, and drive ring 48. Seal 50 is positioned inside compression sleeve 40, after which the combination is slid onto/into body 22 after nut 24 is slid over the outside of body 22.

Figure 5:
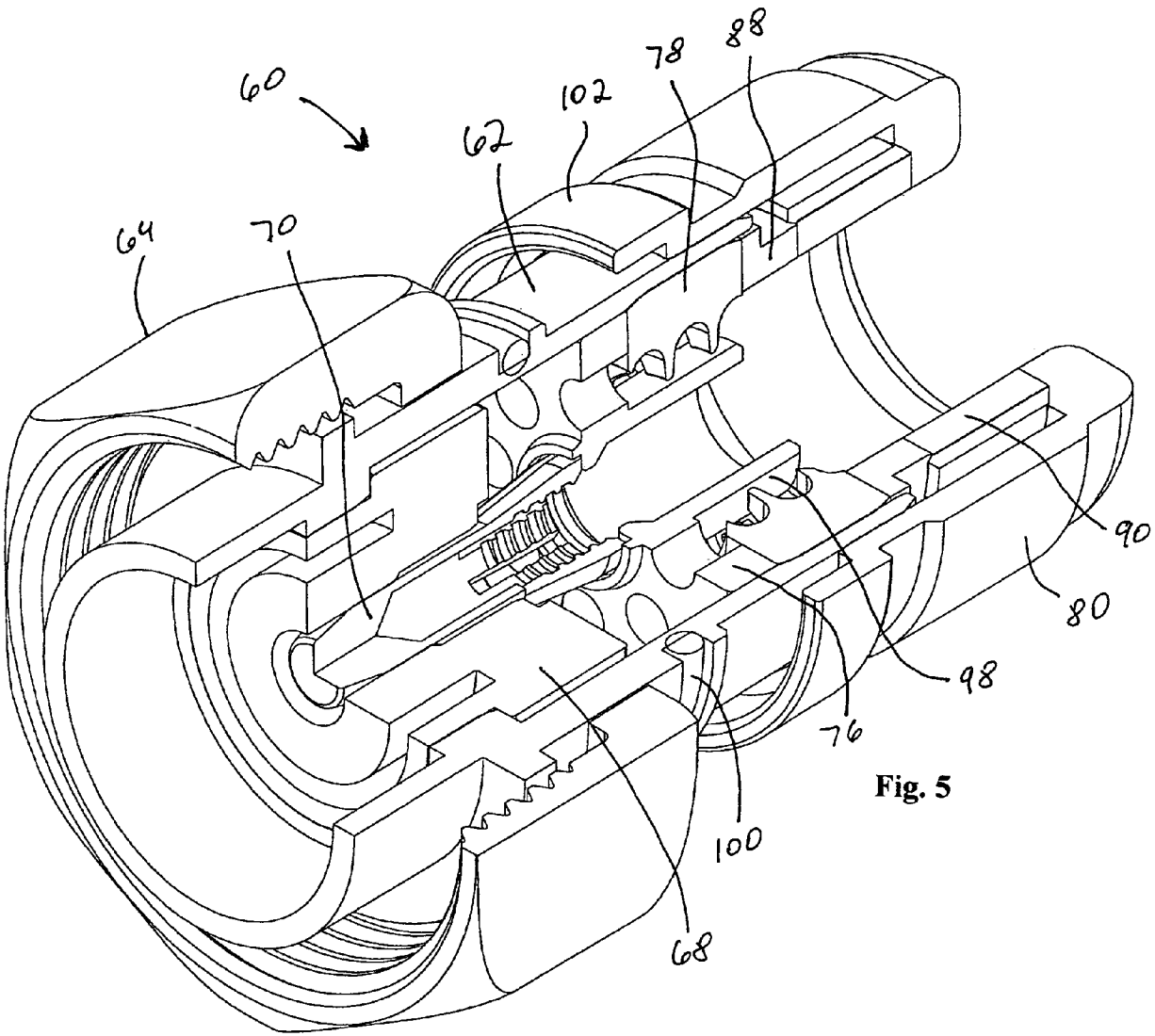
FIG. 5 shows a perspective view with a partial cut-away of a coaxial cable connector in accordance with a second embodiment of the present invention for use with an annular corrugated coaxial cable.

Referring now to FIGS. 5-6, and referring back to FIG. 1B, a compression connector 60 is similar to compression connector 20 of FIGS. 2-4, but with a mandrel 76 having an extended portion 98 which fits into hollow 58 of corrugated coaxial cable 10' during installation of connector 60 onto cable 10'. Extended portion 98 provides support to the spiral corrugated conductor layer 14 during compression. Another difference between embodiments is that a body 62 of connector 60 is shaped somewhat differently to accommodate an O-ring 100 which provides sealing with a portion 102 of a compression sleeve 80 when connector 60 is installed onto cable 10'. The remainder of the components of connector 60 interoperate the same way as the components of the embodiment of connector 20 and are not described further herein.

Figure 7:
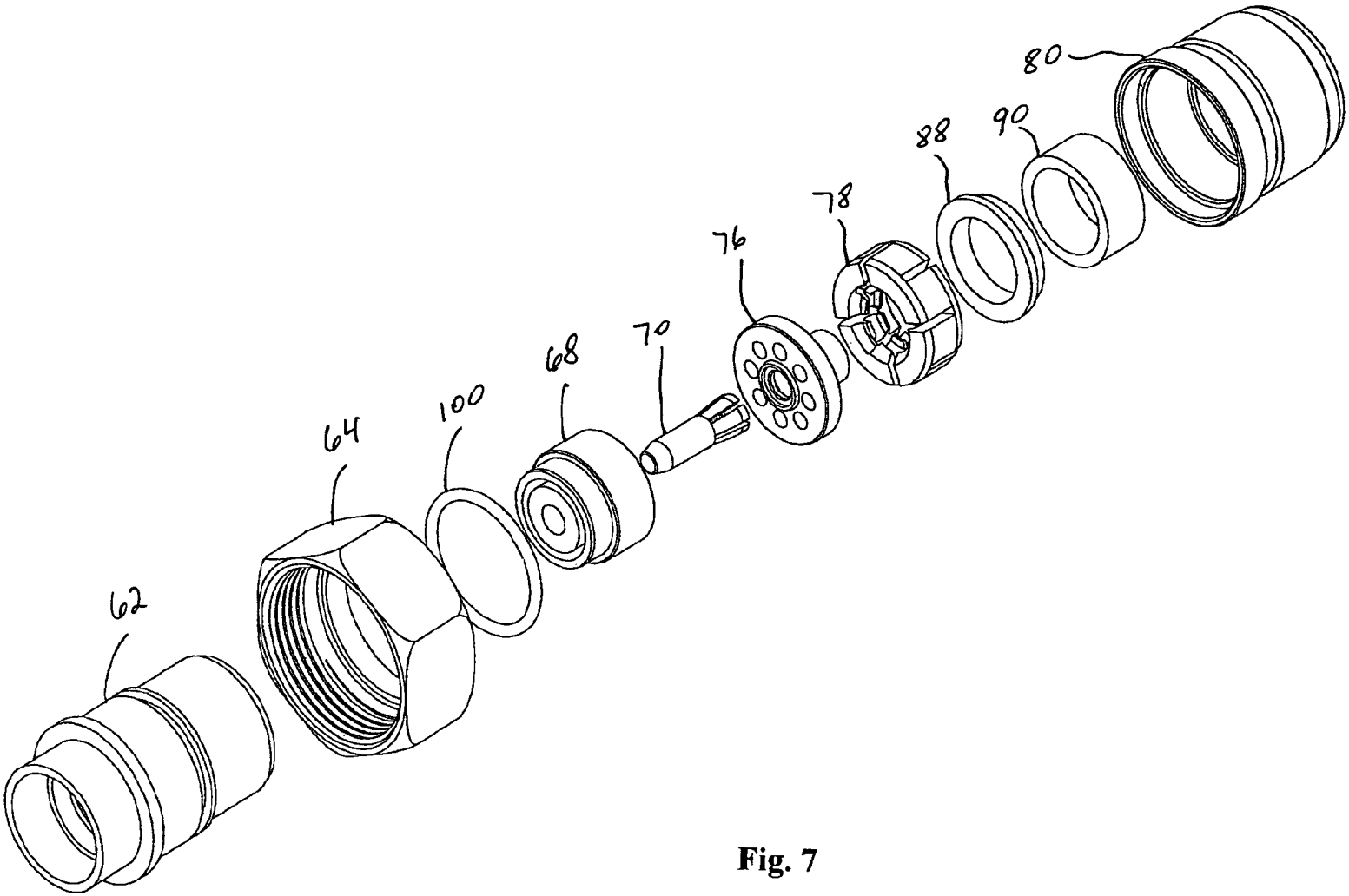
FIG. 7 shows an exploded view of the coaxial cable connector of FIG. 6.

Referring to FIG. 7, an exploded view is shown of the components of connector 60. During preferred assembly, an O-ring 100 is placed onto body 62. A conductive pin 70 is inserted into insulator 68, after which the combination is inserted into body 62, followed by mandrel 76, a clamp 78, and a drive ring 88. A seal 90 is positioned inside compression sleeve 80, after which the combination is slid onto/into body 62 after nut 64 is slid over the outside of body 62. During compression, an inner diameter of seal 90 decreases, thus forming a seal around jacket 12. This provides strain relief on the cable and also aids in cable retention.

Figure 8:
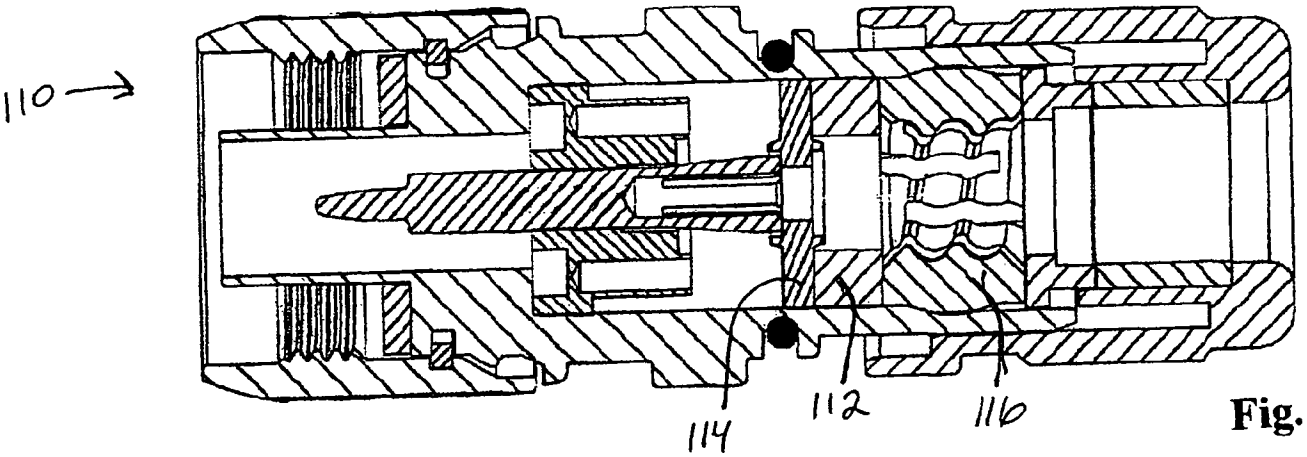
FIG. 8 shows a cross-section of a coaxial cable connector taken along the line 8-8 in FIG. 9 in accordance with a third embodiment of the present invention shown in the uninstalled position.
Figure 9:
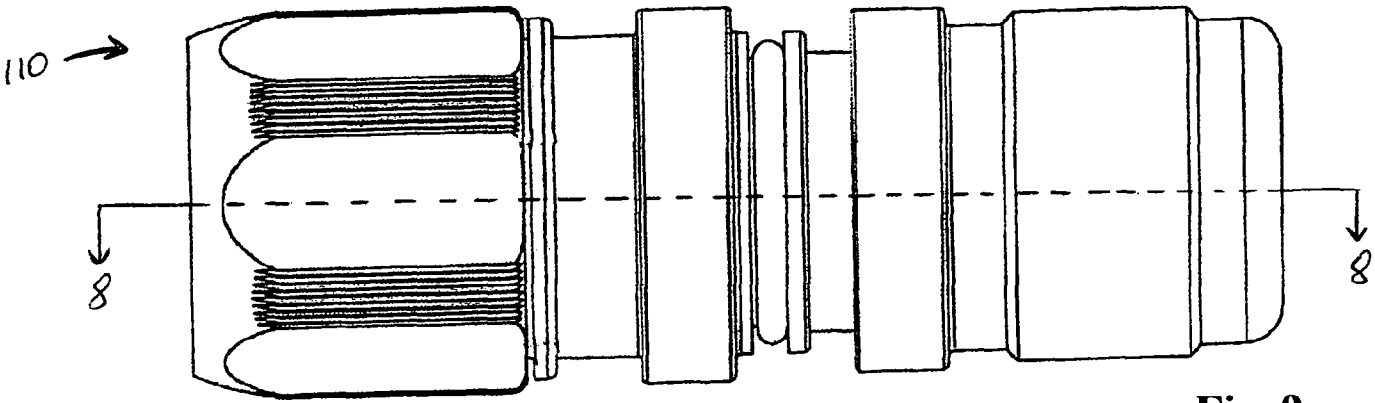
FIG. 9 shows a side elevation view of the coaxial cable connector of FIG. 8.
Figure 10:
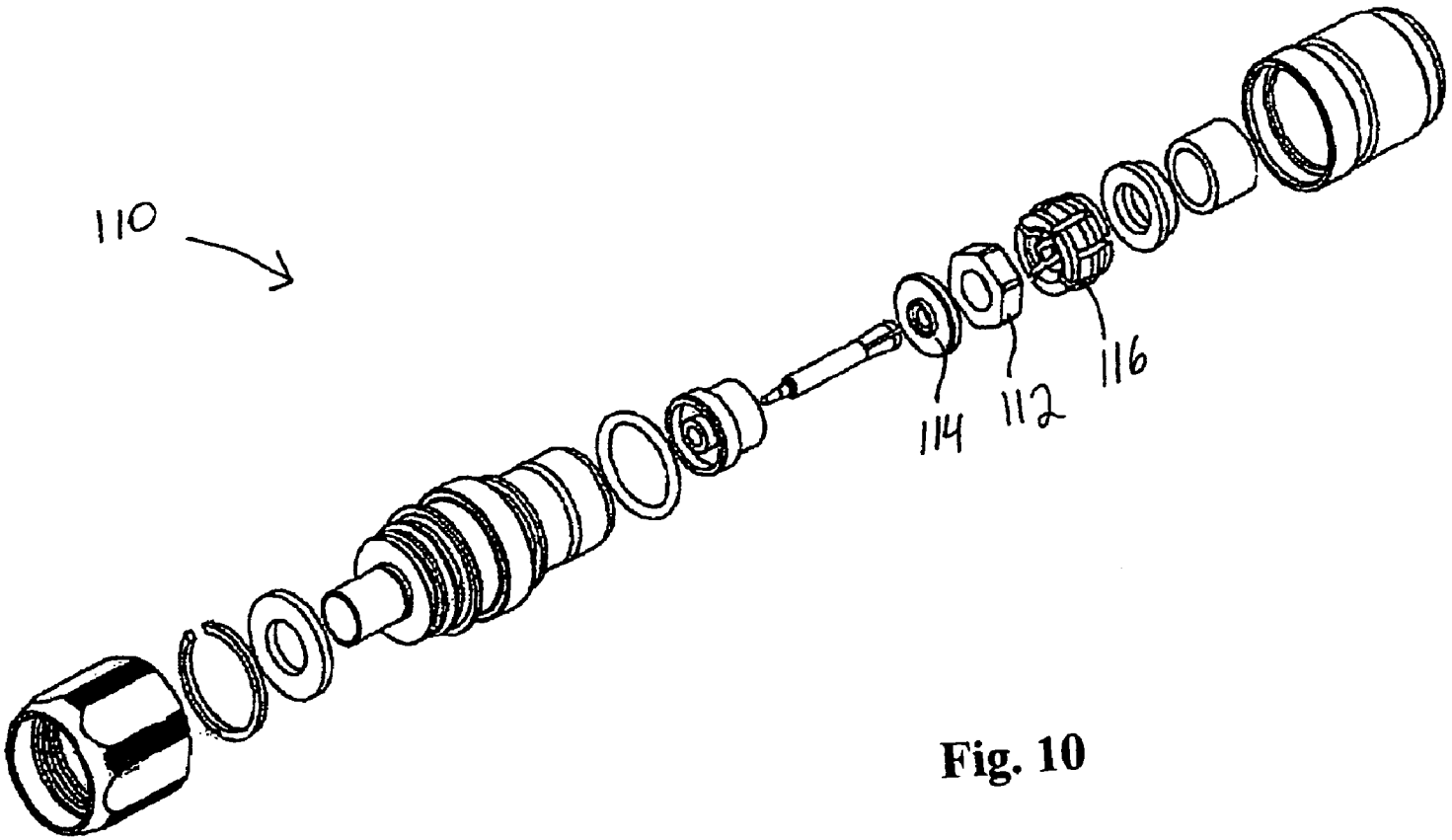
FIG. 10 shows an exploded view of the coaxial cable connector of FIG. 2.

Referring to FIGS. 8-10, a compression connector 110 is shown which is similar to the previous embodiments, but which includes a spacer 112 between a mandrel 114 and a clamp 116. The addition of spacer 112 may assist in better impedance matching. During installation of connector 110 onto corrugated coaxial cable 10 (FIG. 1A), clamp 116 forces spacer 112 against mandrel 114 instead of acting directly against mandrel 114. It should be obvious to one of ordinary skill in the art that such variations are within the scope of the invention. The remainder of the components of this embodiment interact in the same manner as the previous embodiments, so that further description is omitted.

Figure 11B:
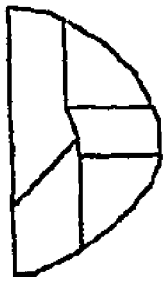
FIG. 11B shows an expanded view of a convex transitional surface circled in FIG. 11 in accordance with an embodiment the present invention.
Figure 11A:
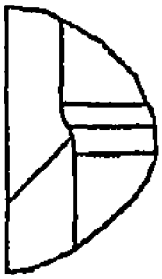
FIG. 11A shows an expanded view of a transitional surface circled in FIG. 11 in accordance with an embodiment the present invention.
Figure 11D:
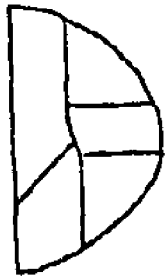
FIG. 11D shows an expanded view of a concave transitional surface circled in FIG. 11 in accordance with an embodiment the present invention.
Figure 11C:
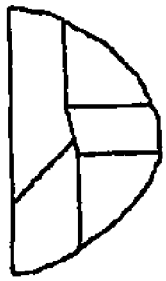
FIG. 11C shows an expanded view of a ramped transitional surface circled in FIG. 11 in accordance with an embodiment the present invention.
Figure 11:
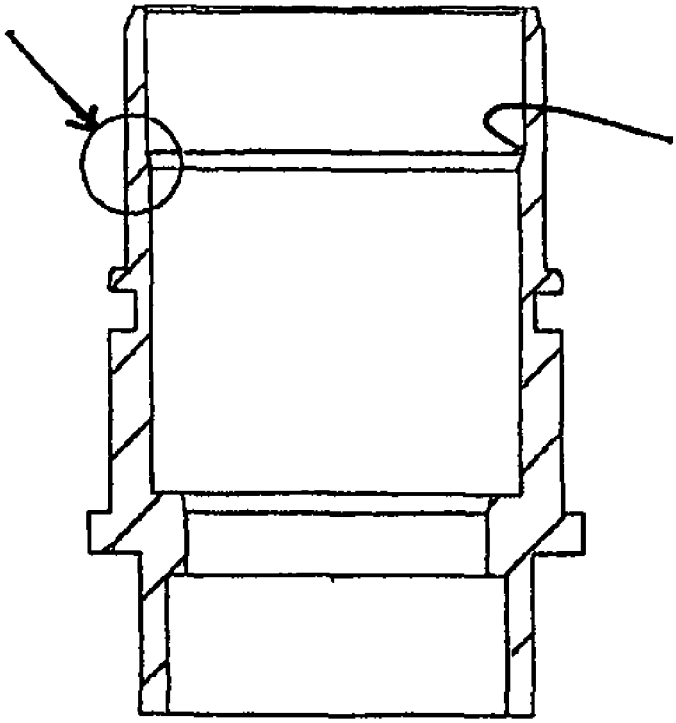
FIG. 11 shows a cross-section of a connector body in accordance with an embodiment of the present invention.

Referring to FIG. 11, transition surface 52 may take various forms, including a shoulder, a ramped or tapered surface, or various shapes such as convex, concave or radial. FIG. 11A shows a shoulder, FIG. 11B shows a convex surface, FIG. 11C shows a ramped surface, and FIG. 11D shows a concave surface.

Figure 12:
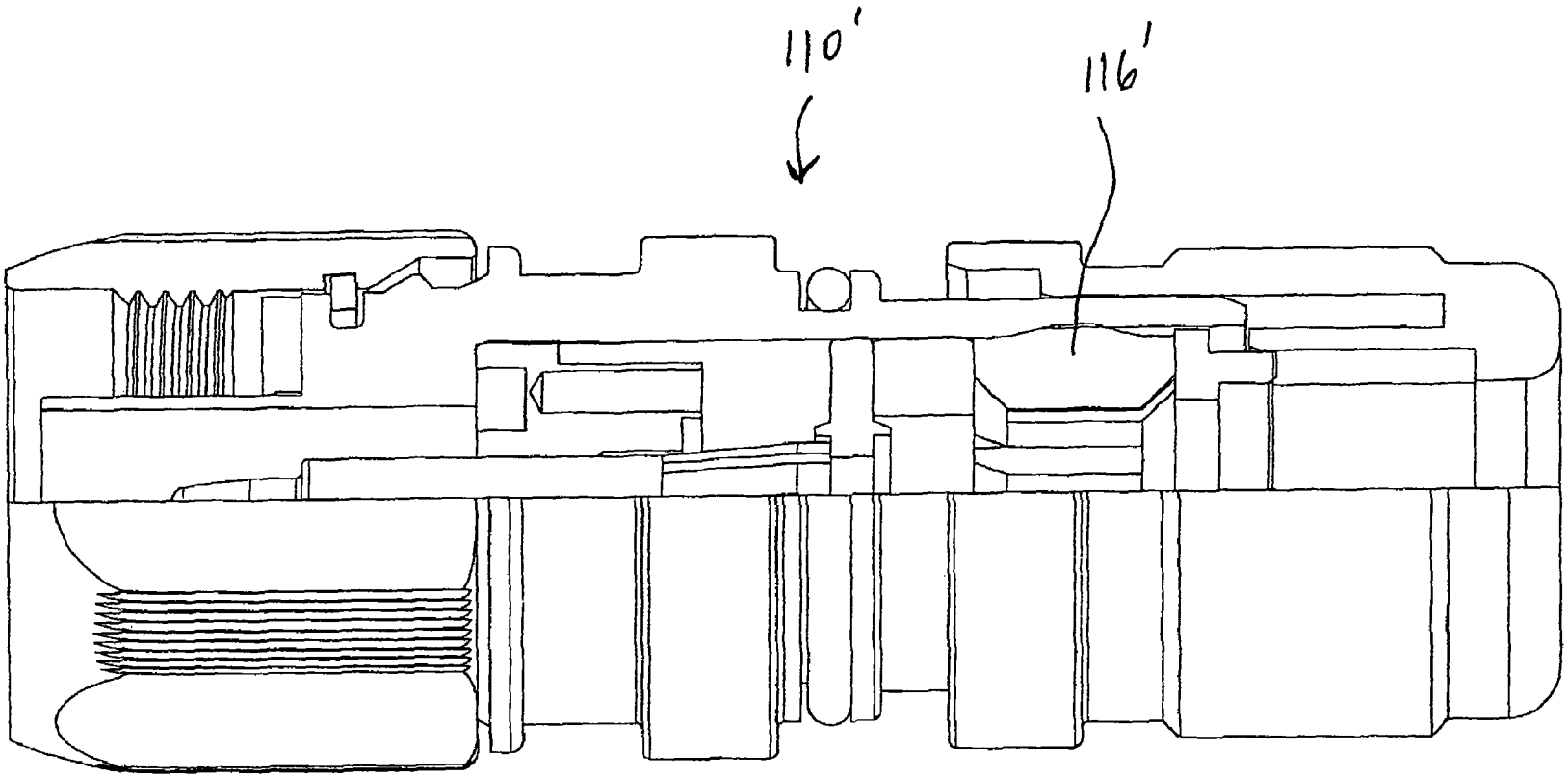
FIG. 12 shows a cross-section of a coaxial cable connector according to an embodiment of the present invention which is similar to the cable connector of FIG. 8 but intended for installation on a smooth-walled coaxial cable.

Referring to FIG. 12, a coaxial cable connector 110' is shown which is similar to cable connector 110 (FIG. 8) but which is intended for installation on smooth-walled coaxial cable 10''' (FIG. 1D). Note that clamp 116', unlike clamp 116 of FIG. 8, does not contain valleys and ridges corresponding to the valleys and ridges of corrugated coaxial cable in order to provide greater gripping surface.

During installation of any of these embodiments onto spiral corrugated coaxial cable 10 (FIG. 1A), non-spiral corrugated coaxial cable 10'', and smooth walled coaxial cable 10''', connectors 20, 60, 110 have to be relatively immovable while compressive force is applied to the respective compression sleeves in the direction of arrow a (FIG. 2). The preferred design of a compression connector tool to accomplish the installation would, while applying the compressive force in the direction of arrow a, stabilize the connector in the opposing direction, thus ensuring that the compressive force was sufficient to squeeze the respective clamps around the conductor layer of the corrugated coaxial cable and squeeze the respective collet portions onto the center conductor. Although the squeezing of the respective clamps begins slightly before the squeezing of the respective collet portions, the squeezing of the respective clamps and collet portions mainly happens simultaneously, unlike with prior art embodiments which require a two-stage operation.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A compression connector for a coaxial cable, wherein the coaxial cable includes a center conductor surrounded by a dielectric, which dielectric is surrounded by a conductor layer, comprising:

a connector body having a first end and a second end and a central passageway therethrough;

an insulator disposed within the central passageway at the first end of the body;

the insulator having an opening therein;

a compression sleeve assembly connected to the second end of the body;

first clamp means, disposed in the central passageway, for clamping onto the conductor layer; and second clamp means, disposed within the central passageway, for clamping onto the center conductor, whereby upon axial advancement of the compression sleeve assembly from the second end to the first end, the first and second clamp means are radially compressed inwardly.

2. A compression connector according to claim 1, wherein the second clamp means includes a conductive pin having a collet portion at one end thereof, wherein an outer diameter of the collet portion is greater than a diameter of the opening in the insulator, such that forcing the conductive pin in the longitudinally axial direction causes the outer diameter of the collet portion to reduce in size as the collet portion is forced into the opening.

3. A compression connector according to claim 2, further comprising a drive ring disposed between the compression sleeve assembly and the first clamp means.

4. A compression connector according to claim 2, further comprising a mandrel disposed between the first clamp means and the collet portion.

5. A compression connector according to claim 4, wherein the mandrel includes an extended portion which extends inside the clamp.

6. A compression connector according to claim 4, further comprising a spacer disposed between the clamp and the mandrel.

7. A compression connector according to claim 2, wherein the first clamp means includes:

a clamp having an outer diameter and a transition surface disposed on an inside of the body;

wherein the transition surface separates the body into a first portion having a first inner diameter and a second portion having a second inner diameter;

wherein the outer diameter of the clamp is substantially the same as the first inner diameter, but greater than the second inner diameter; and wherein forcing the clamp in the longitudinally axial direction causes the outer diameter of the clamp to reduce in size as the clamp is forced from the first portion of the body to the second portion of the body.

8. A compression connector according to claim 7, further comprising a drive ring disposed between the compression sleeve assembly and the clamp.

9. A compression connector according to claim 1, wherein the first clamp means includes:

a clamp having an outer diameter and a shoulder disposed on an inside of the body;

wherein the transition surface separates the body into a first portion having a first inner diameter and a second portion having a second inner diameter;

wherein the outer diameter of the clamp is substantially the same as the first inner diameter, but greater than the second inner diameter; and wherein forcing the clamp in the longitudinally axial direction causes the outer diameter of the clamp to reduce in size as the clamp is forced from the first portion of the body to the second portion of the body.

10. A compression connector according to claim 9, further comprising a drive ring disposed between the compression sleeve assembly and the clamp.

11. A compression connector according to claim 9, further comprising a mandrel disposed between the clamp and the collet portion.

12. A compression connector according to claim 11, wherein the mandrel includes an extended portion which extends inside the clamp.

13. A compression connector according to claim 10, further comprising a spacer disposed between the clamp and the mandrel.

14. A method for installing a compression connector onto a coaxial cable, wherein the coaxial cable includes a center conductor surrounded by a dielectric, which dielectric is surrounded by a conductor layer, comprising the steps of:

providing a connector body having a first end and a second end and a central passageway therethrough;

providing an insulator disposed within the central passageway at the first end of the body;

providing an opening within the insulator;

connecting a compression sleeve assembly to the second end of the body;

providing a first clamp for clamping onto the conductor layer, the first clamp being disposed in the central passageway;

providing a second clamp for clamping onto the center conductor, the second clamp being disposed in the central passageway; and transmitting a force in a longitudinally axial direction of the body from the compression sleeve assembly to both the first and second clamps, wherein an axial movement of the compression sleeve assembly from the second end to the first end causes both the first and second clamps to radially compress inwardly.

15. A method for manufacturing a compression connector for a coaxial cable, wherein the coaxial cable includes a center conductor surrounded by a dielectric, which dielectric is surrounded by a conductor layer, comprising the steps of:

forming a connector body having a first end and a second end, and a central passageway therethrough;

forming an insulator for placement within the central passageway at the first end of the body, wherein the insulator includes an opening therein;

forming a compression sleeve assembly for connection to the second end of the body;

forming a clamp having an outer diameter and a transition surface disposed on an inside of the body; wherein the shoulder separates the body into a first portion having a first inner diameter and a second portion having a second inner diameter; wherein the outer diameter of the clamp is substantially the same as the first inner diameter, but greater than the second inner diameter; and wherein forcing the clamp in the longitudinally axial direction causes the outer diameter of the clamp to reduce in size as the clamp is forced from the first portion of the body to the second portion of the body; and forming a conductive pin having a collet portion at one end thereof, wherein an outer diameter of the collet portion is greater than a diameter of the opening in the insulator, such that forcing the conductive pin in the longitudinally axial direction causes the outer diameter of the collet portion to reduce in size as the collet portion is forced into the opening, wherein an axial movement of the compression assembly causes both the clamp and the collet portion to clamp inwardly.

16. A method according to claim 15, further including the step of forming a drive ring for placement between the compression sleeve assembly and the clamp.

17. A method according to claim 15, further including the step of forming a mandrel for placement between the clamp and the collet portion.

18. A method according to claim 17, wherein the step of forming a mandrel includes the step of forming an extended portion as part of the mandrel, wherein the extended portion extends in an axial direction of the cable connector.

19. A method according to claim 15, further including the step of forming a spacer for placement between the clamp and the mandrel.

20. A connector for coupling an end of a coaxial cable, the coaxial cable having a center conductor surrounded by a dielectric, the dielectric surrounded by a conductor layer, the connector comprising:

a connector body having a first end and a second end, the connector body extending along a longitudinal axis and having defined therein an internal passageway, the first end having a first outer diameter and a first inner diameter;

a first clamp positioned within the first inner diameter and having a first clamp central passageway configured for receiving the conductor layer, the first clamp further having an outer surface for engagement with a first surface on the central passageway configured to radially inwardly compress the first clamp;

an insulator axially positioned within the second end of the connector body and having an insulator passageway;

a second clamp assembly positioned along the longitudinal axis of the connector body between the first clamp and the insulator and having a second clamp central passageway for receiving the center conductor;

the second clamp assembly having a surface portion extending into the insulator passageway; and a compression assembly positioned at the first end of the connector body for engagement with the first clamp, the compression assembly having a compression assembly passageway for receiving the coaxial cable, wherein axial advancement of the compression assembly moves the first clamp member toward the first surface to compress the first clamp radially inwardly to engage the conductor layer of the coaxial cable, and wherein further axial advancement of the compression assembly moves the second clamp assembly surface portion towards the insulator passageway, whereby the second clamp central passageway is radially inwardly compressed to engage the center conductor of the coaxial cable.

21. The connector according to claim 20, wherein the compression assembly comprises a drive ring having a drive inner diameter mounted for operation with the first clamp.

22. The connector according to claim 21, wherein the compression assembly further comprises:

an elastomeric seal positioned within the first end of the connector body; and a compression sleeve positioned at the first end of the connector body, wherein axial advancement of the compression sleeve along the longitudinal axis causes the elastomeric seal to expand radially to engage the corrugated conductor.

23. The connector according to claim 20, wherein the first clamp further comprises at least one slot extending from an outer diameter to the first clamp central passageway.

24. The connector according to claim 20, wherein the second clamp assembly comprises a collet and a mandrel, the mandrel configured to engage the first clamp.

25. The connector according to claim 24, wherein the collet comprises at least one slot extending partially from an outer surface of the collet to the second clamp central passageway.

26. The connector according to claim 24, wherein the collet includes a ramped surface for engagement with the insulator.

27. The connector according to claim 26, wherein the second clamp central passageway has at least one grooved surface configured to remove excess dielectric from the center conductor as the second clamp central passageway receives the center conductor.

28. The connector according to claim 20, further comprising an o-ring, the o-ring operatively attached to an outer surface of the connector body.

29. A connector for coupling an end of a coaxial cable, the coaxial cable having a center conductor surrounded by a dielectric, the dielectric surrounded by an outer conductor, the connector comprising:

a connector body extending along a longitudinal axis, the connector body having defined therein a connector body central passageway, the connector body having a first end and a second end, the first end having a first end internal diameter and a first end outer diameter;

a compression member assembly configured to axially slidably engage the first end outer diameter;

a first clamp located within the connector body passageway, the first clamp having a first clamp central passageway, the first clamp central passageway having an internal surface configured to receive the outer conductor of the coaxial cable;

a mandrel located within the connector body central passageway for engagement with the first clamp, the mandrel configured to receive the center conductor;

a second clamp located within the connector body central passageway, the second clamp having a second clamp central passageway configured to receive the center conductor; and an insulator located within the connector body central passageway, the insulator configured to receive a portion of the second clamp, wherein axial advancement of the compression member assembly along the longitudinal axis of the connector body compresses the first clamp radially inwardly to engage the outer conductor, and wherein further axial advancement of the compression member assembly along the longitudinal axis of the connector body causes movement of the mandrel toward the second clamp, whereby the insulator receives a portion of the second clamp which compresses the second clamp radially inwardly to engage the center conductor.

30. The connector according to claim 29, wherein the connector body internal passageway has a first surface configured to compress the first clamp.

31. The connector according to claim 30, wherein the compression member assembly comprises:

a drive ring having a ring inner diameter mounted for operation with a portion of the first fastening member.

32. The connector according to claim 31, wherein the compression member assembly further comprises:

an elastomeric seal axially positioned within the first end of the connector body; and a compression sleeve axially positioned at the first end of the connector body, wherein axial advancement of the compression sleeve along the longitudinal axis of the connector body causes the elastomeric seal to expand radially to engage the outer conductor.

33. The connector according to claim 29, wherein a portion of the second clamp has an outer surface configured to radially inwardly compress the second clamp upon engagement with the insulator, whereby the second clamp engages the center conductor upon advancement of the second clamp.

34. The connector according to claim 33, wherein the second clamp has at least one slot extending from an outer diameter of the second clamp to the second clamp central passageway wherein the at least one slot allows the second clamp to be compressed radially inwardly to engage the center conductor.

35. The connector according to claim 29, wherein the first clamp has at least one slot extending from a outer diameter of the first clamp to the first clamp central passageway wherein the at least one slot allows the first clamp to be compressed radially inwardly to engage the outer conductor.

36. The connector according to claim 29, wherein a portion of the mandrel is configured to be located within a portion of the first clamp central passageway.

* * * * *